United States Patent [19]

Wiget

[11] 4,155,218

[45] May 22, 1979

[54] ELECTRONIC WATCH

[75] Inventor: Fridolin Wiget, Neuchatel, Switzerland

[73] Assignee: Ebauches S.A., Neuchatel, Switzerland

[21] Appl. No.: 789,198

[22] Filed: Apr. 20, 1977

[30] Foreign Application Priority Data

Apr. 23, 1976 [CH] Switzerland ..... 5120/76

[51] Int. Cl.[2] ..... G04C 3/00

[52] U.S. Cl. ..... 58/23 R; 58/85.5

[58] Field of Search ..... 58/23 R, 23 AC, 50 R, 58/23 A, 85.5; 328/48

[56] References Cited

U.S. PATENT DOCUMENTS

| | | | |
|---|---|---|---|
| 3,777,471 | 12/1973 | Koehler et al. | 58/25 R |
| 3,889,460 | 6/1975 | Yasukawa et al. | 58/23 R |
| 3,895,486 | 7/1975 | Hammer et al. | 58/23 R |
| 3,914,931 | 10/1975 | Tsuruishi | 58/23 R |
| 4,030,284 | 6/1977 | Portmann | 58/23 R |
| 4,044,547 | 8/1977 | Kusumoto | 58/85.5 |
| 4,045,952 | 3/1976 | Kashio | 58/23 R |
| 4,067,187 | 1/1978 | Sekiya et al. | 58/23 R |

*Primary Examiner*—Robert K. Schaefer
*Assistant Examiner*—Vit W. Miska
*Attorney, Agent, or Firm*—Silverman, Cass & Singer, Ltd.

[57] ABSTRACT

In an electronic watch, the content of the memory associated with the adjusting circuit of the division ratio of the frequency divider is modified at each correction of the display to compensate for the frequency error of the crystal oscillator and to thereby reduce the running error of the watch. Such electronic watches use a crystal oscillator whose frequency is not optimum. To compensate for the frequency variations due to manufacturing tolerances, age and temperature, correction circuits are incorporated into such watches. When an operator acts on a switch on the case of the watch to correct the time display indication, the content of the memory is modified to correct for the frequency error of the crystal oscillator.

3 Claims, 4 Drawing Figures

ELECTRONIC WATCH

The present invention relates to an electronic watch including a quartz oscillator, a frequency divider having a division ratio which is adjustable, an adjusting circuit of the division ratio, a memory containing the information relating to the value of the adjustment and, counting and display circuits of the hour indications including at least a seconds counter. A first logic circuit the output of which takes a first state when the seconds counter is from 0 to 29 seconds and a second state during the rest of the time, a correction circuit for the state of the counting circuits and a control means for the correction circuit are also included.

Several systems have been suggested for allowing the use in the oscillator of a watch a quartz crystal the proper frequency of which does not need to be very precise, while refraining from using a trimmer condenser which is expensive and cumbersome. Such devices based on the use of frequency dividers having an adjustable division ratio have been disclosed, for instance, in U.S. Pat. Nos. 3,895,486 and 3,747,471. In these systems, an adjusting circuit is connected to the frequency divider and it either removes a number of pulses from the pulses which are delivered by the oscillator during a determined time, the frequency of the oscillator having been chosen voluntarily too high (U.S. Pat. No. 3,895,486) or; it reduces the division ratio of the counter while putting the counter into a predetermined condition which is different from its rest condition at the end of each cycle of division, which permits one to use a quartz crystal the frequency of which is lower than the nominal frequency (U.S. Pat. No. 3,747,471).

Whatever the system chosen may be, the adjusting circuit is connected to a memory which contains the information relating to the value of the adjustment to be realized. This memory can be of several types, it may especially be constituted with bistable electronic elements, the only case which will be considered here.

In the systems which are presently knwon, the record in the memory and the eventual correction of the information desired are not available to the user, since they require precise apparatus permitting one to measure the running of the watch. The present invention permits one to remove this drawback.

Owing to their precision, the electronic watches can be set only at rather long intervals of time, but this operation needs generally rather complicated manipulations. A system simplifying these manipulations and which is usable when the difference between the actual time and the time indicated by the watch does not go over ±30 seconds has been disclosed, for instance, in the U.S. Pat. No. 3,889,460. In this system, an operation of the control means, for instance a pushbutton, at a time situated in the beginning of a minute of the actual time indicated by another means (clock of reference, braodcast time signal, etc.) produces the sending of a supplementary pulse to the minutes counter, if the watch is slow, and the reset to zero of the seconds counter in all the cases.

The purpose of the present invention is to realize a watch in which the content of the memory associated with the adjusting circuit of the division ratio of the frequency divider will be modified at each correction of the condition of the watch, so as to reduce to a minimum the running of this latter. It is here to be noted that one understands by "condition" of the watch the difference between the time it indicates and the actual time and by "running" the variation of this condition, expressed, for instance, in seconds/day (s/d).

The watch according to the invention is characterized by the fact that its memory is formed of a reversible binary counter and of a second logic circuit, the outputs of which are connected to the inputs of the reversible counter, and the inputs of which are connected, on the one hand, to the said control means, and, on the other hand, to the output of the said first logic circuit, the whole in such a way that, at each action on the control means, the content of the reversible counter is modified in the sense corresponding to a correction of the running of the watch.

The drawings show, by way of example, two embodiments of the object of the invention.

Figure 1:
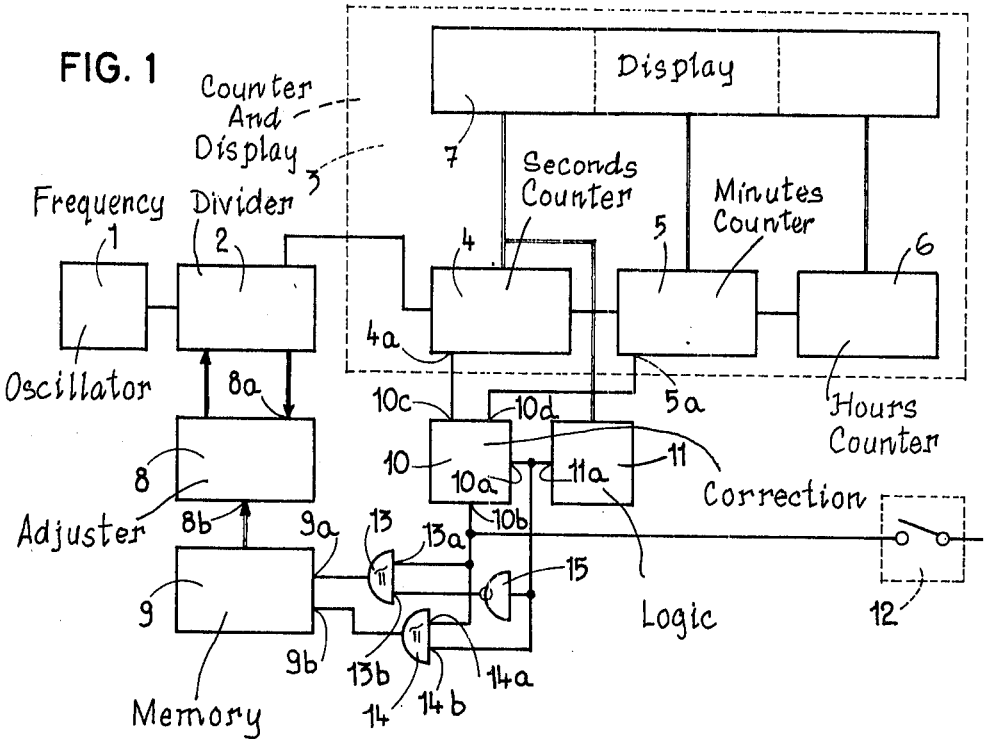
FIG. 1 is the diagram of the first embodiment.

The watch illustrated in FIG. 1 comprises a quartz oscillator 1, which sends pulses, at a frequency of, for instance, 32,768 Hz, with a positive or negative tolerance of the order of 1 for 10,000, to a frequency divider 2, the division ratio of which is adjustable, intended to reduce the frequency of the pulses delivered by the oscillator to a precise frequency of, for instance, 1 Hz, a counting and display circuit of the hour indications 3 comprising at least a seconds counter 4, a minutes counter 5 and a hours counter 6, as well as a display device 7. An adjusting circuit 8 of the rate of division of the frequency divider, the operation of which is disclosed in the above mentioned documents (U.S. Pat. No. 3,895,486 and 3,747,471), receives on its input 8*a* the information relating to the duration of the adjusting period, and on its inputs 8*b* the information concerning the value of this adjustment, which is contained in a memory 9.

One sees also on this FIG. 1 the correction circuit 10 of the condition of the watch, usable when this condition does not go over ±30 seconds. The input 10*a* of this circuit 10 is connected to an output 11*a* of a logic circuit 11 which is at a logic state, for instance "0," when the seconds counter is between 0 and 29, and at the other logic state, for instance, "1," during the rest of the time. The input 10*b* of this circuit 10 is connected to a control means 12 here symbolised by a contact. Its outputs 10*c* and 10*d* are respectively connected to the inputs 4*a* and 5*a* of the counters 4 and 5. The operation of this circuit is disclosed in the publication hereabove mentioned (U.S. Pat. No. 3,889,460), so that it does not seem necessary to repeat it here.

The memory 9 containing the information relative to the value of the adjustment to be realized is a reversible counter, that means that the pulses it receives on one of its inputs, for instance the input 9*a*, produces an increment of its content, while the pulses it receives on its other input, in the present example the input 9*b*, produces a decrement of its content. These inputs 9*a* and 9*b* are connected to the outputs of a logic circuit comprising AND gates 13 and 14 and an inverter 15. The inputs 13*a*, and 14*a*, are connected to the contact 12. The inputs 13*b*, and 14*b* respectively are connected, the one, 13*b*, by the intermediary of inverter 15, the other, 14*b*, directly, to the output 11*a* of the logic circuit 11. FIG. 1 represents the case where the adjusting circuit of the division ratio 8 works by cancellation of pulses. If this circuit of adjustment would work by addition of pulses or by preselection of the flip-flops of the divider, the connections between the outputs of the gates 13 and 14 and the inputs of the counter 9 would have to be crossed.

The operation of this circuit is the following.

When the user, ascertaining that his watch is fast or slow, acts on the control means, for instance a button closing the contact 12, at the moment of a broadcast time signal indicating the beginning of a precise minute, for setting the watch, the pulse delivered by the contact 12 to the circuit of correction 10 acts also on the inputs 13*a* and 14*a* of the AND gates 13 and 14. At this moment, if the watch is fast, the output 11*a* of the logic circuit 11 is in the logic state "0." The AND gate 14 is consequently disabled, while the gate 13 lets this pulse pass. If, on the other hand, the watch is slow, the output 11*a* of the logic circuit 11 is in the logic state "1," and it is the AND gate 14 which lets this pulse pass. In the case of FIG. 1, it can be seen that the input 9*a* of the counter 9 receives this pulse when the watch is fast, and the input 9*b* when the watch is slow. Because the pulses received by the input 9*a* increase the content of the counter, and because the content of the counters is the number of pulses cancelled by the adjusting circuit 8, the speed of the watch is reduced. If the watch is slow, it is the input 9*b* which receives this pulse, that has effect of reducing the number of the pulses cancelled by the adjusting circuit, and consequently of reducing the speed of the watch is increased. A similar reasoning could be hold for the case where the adjustment circuit would work by the addition of pulses or by preselection of the flip-flops of the divider 2.

When the watch is interrupted, at the change of a battery, for instance, the content of the memory 9 is lost. A watch comprising circuits permitting one to rapidly reset the memory into its prior condition is diagrammatically represented in FIG. 2. It can be seen in this figure that, in addition to the circuits disclosed in the case of FIG. 1, the watch comprises a switching device 16, receiving on the one hand the hour information coming from the counters 4, 5 and 6 and, on the other hand, the information of the reversible counter 9, transmitted by a code translating circuit 17. A control input 16*a* of the switching device 16 is connected to the output 18*a* of a discriminating circuit 18. These new circuits are disclosed hereafter.

The switching circuit 16 is arranged in a way which is known to all the people skilled in the art of logic circuits and will not be disclosed here, so that the signals applied to the inputs 16*b*, 16*b*' and 16*b*" are transmitted to the outputs 16*d*, 16*d*' and 16*d*" when the control input 16*a* is in the logic state "0" and so that the signals presented to the inputs 16*c*, 16*c*' and 16*c*" are transmitted when this input 16*a* is in the logic state "1."

The translating circuit 17 serves to transform the code in which the information is available at the outputs of the memory 9, generally the pure binary code, into another code, compatible with the display circuit 7, generally the binary coded decimal (BCD). It can be realized with logic gates or, more simply, with a read only memory (ROM), that is known per se and is in the knowledge of any engineer skilled in electronics. Consequently, this circuit also will not be disclosed here.

Figure 3:
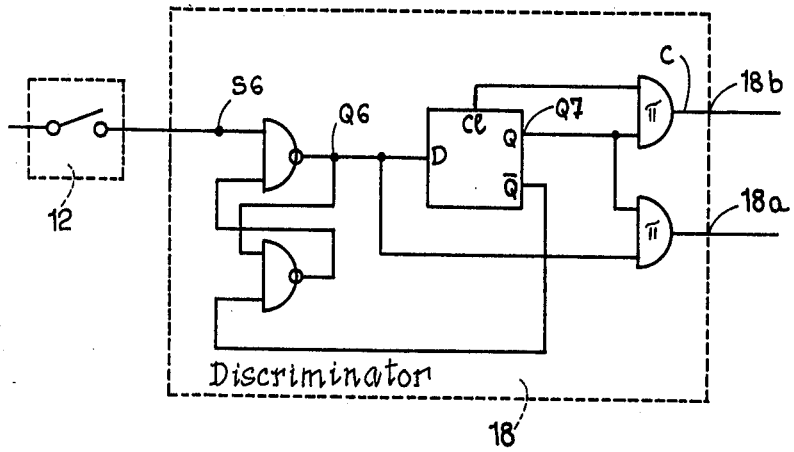
FIG. 3 is the diagram of a detail of FIG. 2.

The discriminator 18 is composed of a circuit such as the one which is disclosed in the U.S. Pat. No. 4,030,284, completed by a mere AND gate. FIG. 3 shows the diagram of this circuit which will not be disclosed here in detail.

This circuit comprises an input S6, connected to a control means, in the present case the contact 12, and an output C, in the present case the output 18*b*, which delivers a unique pulse when the control means is operated for a time less than a given time, and a train of pulses when the control means is operated for a longer time than this given time. This circuit delivers also two signals, to points Q6 and Q7, the combination of which, in an AND gate not provided for in the U.S. Pat. No. 4,030,284, furnishes a continuous signal if the control means is maintained beyond the given time. The output of this AND gate is the output 18*a* of the present circuit 18.

Figure 2:
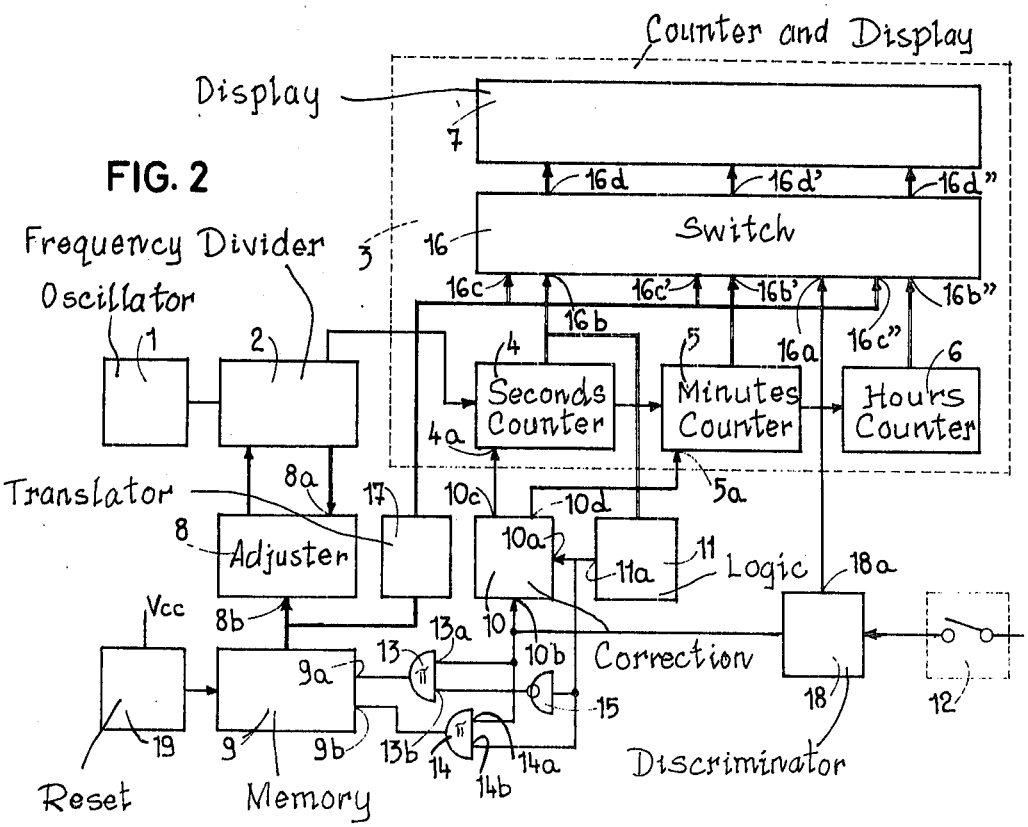
FIG. 2 is the diagram of the second embodiment.

FIG. 2 shows moreover a reset circuit 19 which has for its purpose to oblige the counter 9 to take a predetermined state at the application of power to the watch, especially after a change of battery. This predetermined state is the state corresponding to a zero number if the circuit of adjustment 8 works by cancellation of pulses, or the state corresponding to a maximum number if the circuit 8 works by addition of pulses or by preselection of the flip-flops of the divider 2. Thus, after an interruption of the feeding current, the watch is fast and its running is maximum. This circuit 19 exists already in electronic watches, where it is necessary to reset to zero the counters of the hour indications.

The operation of this complex of circuits is the following.

As indicated previously, after a change of battery, the counter 9 is forced into a condition such that the watch is fast. The watchmaker who has changed the battery can then measure the running of the watch with the apparatus available to him. Knowing the variation of running produced by an increment of the counter 9, he can, by a rapid calculation, determine the value to be introduced into this counter. He acts then in a prolongated manner on the contact 12. The signal delivered, after a short period, by the output 18*a* of the counter 18 to the switch 16, replaces the display of the hour indications with the content of the counter 9. At the same time, the pulses delivered by the output 18*b* increment or decrement the counter 9, so as to reduce the running of the watch. When the display indicates that the desired value is reached, the action on the contact 12 is interrupted. The watch can also be reset by means provided to this effect, not represented, which have no effect on the counter 9.

Figure 4:
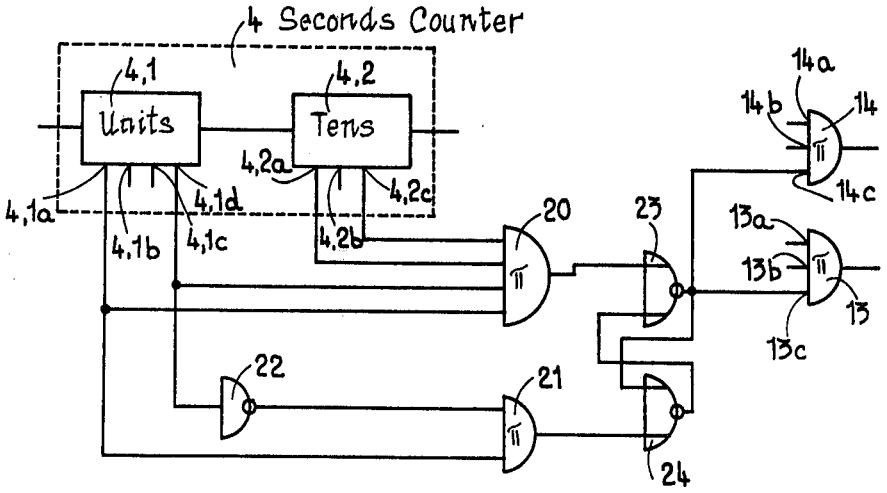
FIG. 4 is the diagram of an addition to the diagram of FIG. 2.

The two embodiments disclosed hereabove have the small following drawback: if the user resets his watch while the difference between the time indicated and the actual time is low, it is possible that, due to the error he commits while acting on the contact 12 too early or too late, the counter 9 will be corrected in a sense which increases the running instead of diminishing it. The circuit shown in FIG. 4 prevents this drawback. In this circuit, the seconds counter 4 is composed of a counter of the units of seconds 4.1 and of a counter of tens of seconds 4.2. The number of units of seconds counted by the counter 4.1 is presented, in binary, to the outputs 4.1*a* to 4.1*d*, the signal on output 4.1*a* being the least significant bit ($2^0$) and the signal on output 4.1*d* being the most significant bit ($2^3$). The means obliging this counter to count by 10 has not been represented. Likewise, the number of the tens of seconds counted by the counter 4.2 is presented, also in binary, to the outputs 4.2*a* to 4.2*c*, the signal on output 4.2*a* being the least significant bit ($2^0$), and the signal on output 4.2c being the most significant bit ($2^2$). The means obliging this counter to count by six has not been represented too. An AND gate 20 is connected to the outputs 4.1a, 4.1d, 4.2a and 4.2c of the counters 4.1 and 4.2. Its output is consequently in the logic state "1" when the counter 4.1 is at 9 and the counter 4.2 at 5, that is to say when the counter 4 is at 59. Another AND gate 21 is connected to the output 4.1a and, by the intermediary of an inverter 22, to the output 4.1d. Its output is consequently at "1" each time the counter 4.1 indicates uneven numbers, 1, 3, 5 or 7.

The outputs of the AND gates 20 and 21 are connected to the inputs of a memory formed by the NOR gates 23 and 24. An output of this memory is connected to supplementary inputs 13c, 14c respectively, of the AND gates 13 and 14.

In normal time, when the seconds counter 4 reaches the number 59, the memory 23,24 goes into a state such that a logic signal "0" is applied on the inputs 13c and 14c of the gates 13 and 14, which locks them. The signals which may arrive from the contact 12 cannot, consequently, reach the counter 9. When the seconds counter 4 reaches the number 1, the memory 23,24 goes back to the state, which brings a logic signal "1" to the inputs 13c and 14c of the gates 13 and 14 which then let pass the possible signals of correction, as it has been disclosed hereabove.

One sees consequently that this circuit prevents any correction of the content of the counter 9 if the difference between the time indicated by the watch and the actual time is less than one second. On the contrary, it does not prevent the rapid resetting of the memory 9 after a change of battery. It is sufficient, as a matter of fact, to start to act on the contact 12 at a moment where the watch indicates a number of seconds comprised between 1 and 29. The memory 23,24 is then in the state which opens the gates 13 and 14. The pulses produced by the contact 12 reset the seconds counter to zero by the intermediary of the circuit of correction 10, without it passing by 59. The memory 23,24 remains consequently in the desired condition.

It is obvious that the circuits disclosed hereabove and the numbers which have been indicated are indicated only by way of non-limitative example, and that other circuits could also be developed for reaching the same results.

What I claim is:

1. An electronic watch comprising a quartz oscillator;

a frequency divider having an adjustable division ratio, connected to receive electrical pulses from said oscillator and produce time standard pulses;

an adjusting circuit connected to said frequency divider for adjusting said division ratio;

a memory circuit connected to said adjusting circuit for storing information relating to the value of said division ratio, said memory circuit including a reversible binary counter having a first and a second input for respectively incrementing and decrementing said information;

time counting circuit having time information outputs and including a seconds counter connected to receive time standard pulses from said frequency divider;

a display circuit for displaying time information, connected to receive time information signals from said time counting circuit;

a first logic circuit connected to said seconds counter and having an output which takes a first state when the content of said seconds counter is from 0 to 29 and a second state when the content of said seconds counter is from 30 to 59;

a correction circuit for setting said time counting circuit to a predetermined time information state;

means for controlling said correction circuit; and a second logic circuit having a first input connected to said controlling means, a second input connected to the output of said first logic circuit, a first and a second output connected respectively to the first and second input of said reversible binary counter, said first and second outputs being respectively enabled by the first and second state of the output of said first logic circuit, and said enabled output being activated by an action on said controlling means, whereby an action on said controlling means sets said time counting circuit to a predetermined time information state and increments or decrements said division ratio information by one unity step in a direction corresponding to the correction of the period of said time standard pulses.

2. The electronic watch of claim 1 further comprising a switching circuit having a first set of inputs of information connected to the time information outputs of said time counters, a second set of inputs of information connected to outputs of said reversible binary counter, a set of outputs connected to said display circuit, and a control input; and a discriminating circuit having an input connected to said control means, a first output connected to the control input of said switching circuit, and a second output connected to the input of said correction circuit and to the input of said second logic circuit, for delivering, in response to prolonged action on said control means, a continuous signal on said first output and a train of pulses on said second output, said continuous signal producing, by the intermediary of said switching circuit, the display of the content of said reversible counter in place of the display of the time information, and said train of pulses producing a modification of said reversible counter.

3. The electronic watch of claim 2 wherein said second logic circuit includes a locking input which, when activated, prevents the first and second outputs of the second logic circuit from being activated by said first and second inputs, and further comprising a third logic circuit having inputs connected to the outputs of said seconds counter and an output connected to the locking input of said second logic circuit for generating an output signal whenever the seconds counter indicates a value between two predetermined values, to prevent a signal from said control means from acting on the contents of the reversible counter whenever the seconds counter is in a predetermined state.

* * * * *